US005983756A

United States Patent [19]

Orloff

[11] Patent Number: 5,983,756

[45] Date of Patent: Nov. 16, 1999

[54] APERTURE RAZOR SYSTEM AND METHOD OF MANUFACTURE

[75] Inventor: Glennis J. Orloff, Woodbridge, Conn.

[73] Assignee: Warner-Lambert Company, Morris Plains, N.J.

[21] Appl. No.: 08/974,040

[22] Filed: Nov. 19, 1997

[51] Int. Cl.[6] ..... B21K 5/12; B21K 11/00

[52] U.S. Cl. ..... 76/104.1; 76/116; 76/DIG. 8

[58] Field of Search ..... 30/49, 346.51; 76/104.1, 116, DIG. 8

[56] References Cited

U.S. PATENT DOCUMENTS

| | | | |
|---|---|---|---|
| 2,168,406 | 8/1939 | Harris | 76/104.1 |
| 2,182,067 | 12/1939 | Bruecker | 76/104.1 |
| 2,223,768 | 12/1940 | Martin | 76/104.1 |
| 3,881,373 | 5/1975 | Nakamura et al. | 76/104.1 |
| 4,061,056 | 12/1977 | Nakamura | 76/104.1 |
| 4,122,603 | 10/1978 | Sastri | 76/104.1 |
| 4,483,068 | 11/1984 | Clifford | 30/49 |
| 5,088,195 | 2/1992 | Lazarchik et al. | 30/49 |
| 5,201,253 | 4/1993 | Lazarchik et al. | 76/116 |
| 5,293,768 | 3/1994 | Lazarchik et al. | 72/311 |
| 5,322,599 | 6/1994 | Peters . | |
| 5,490,329 | 2/1996 | Chylinski et al. | 30/49 |
| 5,492,038 | 2/1996 | Chylinski et al. | 76/116 |

FOREIGN PATENT DOCUMENTS

| | | |
|---|---|---|
| 0191203 | 8/1986 | European Pat. Off. . |
| 0428211 | 5/1991 | European Pat. Off. . |
| 2513555 | 4/1983 | France . |
| 9319887 | 10/1993 | WIPO . |
| 9528258 | 10/1995 | WIPO . |
| 9528259 | 10/1995 | WIPO . |
| 9531315 | 11/1995 | WIPO . |
| 9717158 | 5/1997 | WIPO . |

OTHER PUBLICATIONS

American Machinist—Special Report 743, Mar. 1982—Drilling Without Drills by Guy Bellows and John B. Kohls.

*Primary Examiner*—Hwei-Siu Payer
*Attorney, Agent, or Firm*—Charles W. Almer

[57] ABSTRACT

A method for forming a blade having circular apertures with sharpened edges. As opposed to the traditional grinding and deburring method, the present invention utilizes electrochemical machining, electrical discharge machining, electrolytic machining, laser-beam machining, electron-beam machining, photochemical machining, ultrasonic machining, and other non-traditional methods to sharpen and form the blade edges. These manufacturing methods lend themselves to produce unlimited razor blade designs and structures.

28 Claims, 5 Drawing Sheets

APERTURE RAZOR SYSTEM AND METHOD OF MANUFACTURE

BACKGROUND OF THE INVENTION

1. Field of the Invention

This invention relates to razor systems having a plurality of apertures and methods of manufacturing such razor systems using non-grinding sharpening techniques.

2. Description of Related Art

Efforts to improve wet shave quality have been on-going for many years. Among the avenues for improvement that have been explored are the actual blade and cutting edge design. To this end, razors have been developed with cutting edges which are not straight, as with most traditional blades, but are circular or otherwise rounded apertures located within the body of the blade. Such systems offer the advantage of allowing the user to shave in multiple directions, as opposed to the single direction of most blades. Examples of blades having circular apertures include U.S. Pat. No. 5,604,983, issued to Simms et al., U.S. Pat. No. 5,490,329, issued to Chylinski et al., and U.S. Pat. No. 4,483,068, issued to Clifford. While the dimensions and shape of the actual apertures vary throughout the examples, the methods for producing the apertures in these examples remain virtually the same. The common method for producing the apertures is the traditional grinding method for sharpening blades which requires substantial part manipulation and is sometimes combined with an additional deburring step. Consequently, the manufacture and blade structure of razors having apertures are constrained by the limitations of traditional razor grinding.

It would be advantageous to provide a method for manufacturing razor blades having a plurality of sharpened apertures which does not employ traditional grinding and deburring steps, but instead utilizes more efficient and flexible hole-producing and edge sharpening technology. Accordingly, it is an objective of the present invention to provide a method for producing razor blades having cutting edge apertures which do not utilize the traditional grinding techniques. It is a further objective of the invention to utilize electrochemical machining, electrical discharge machining, electrolytic machining, laser-beam machining, electron-beam machining, photochemical machining, ultrasonic machining, and other non-traditional methods to form cutting edge apertures in razor blades. Accordingly, the structure and design of the cutting edge apertures are not limited to the shapes, sizes, and locations amenable to grinding.

SUMMARY OF THE INVENTION

The present invention is directed to a method for forming a blade having a plurality of apertures with sharpened edges. As opposed to the traditional grinding method, the present invention utilizes electrochemical machining, electrical discharge machining, electrolytic machining, laser-beam machining, electron beam machining, photochemical machining, ultrasonic machining, and other non-traditional methods to sharpen the blade edges. As a result of implementing these non-traditional manufacturing techniques, the resulting blade and edge structure is distinct from blades formed by traditional grinding methods.

DETAILED DESCRIPTION OF THE EMBODIMENTS

Figure 1:
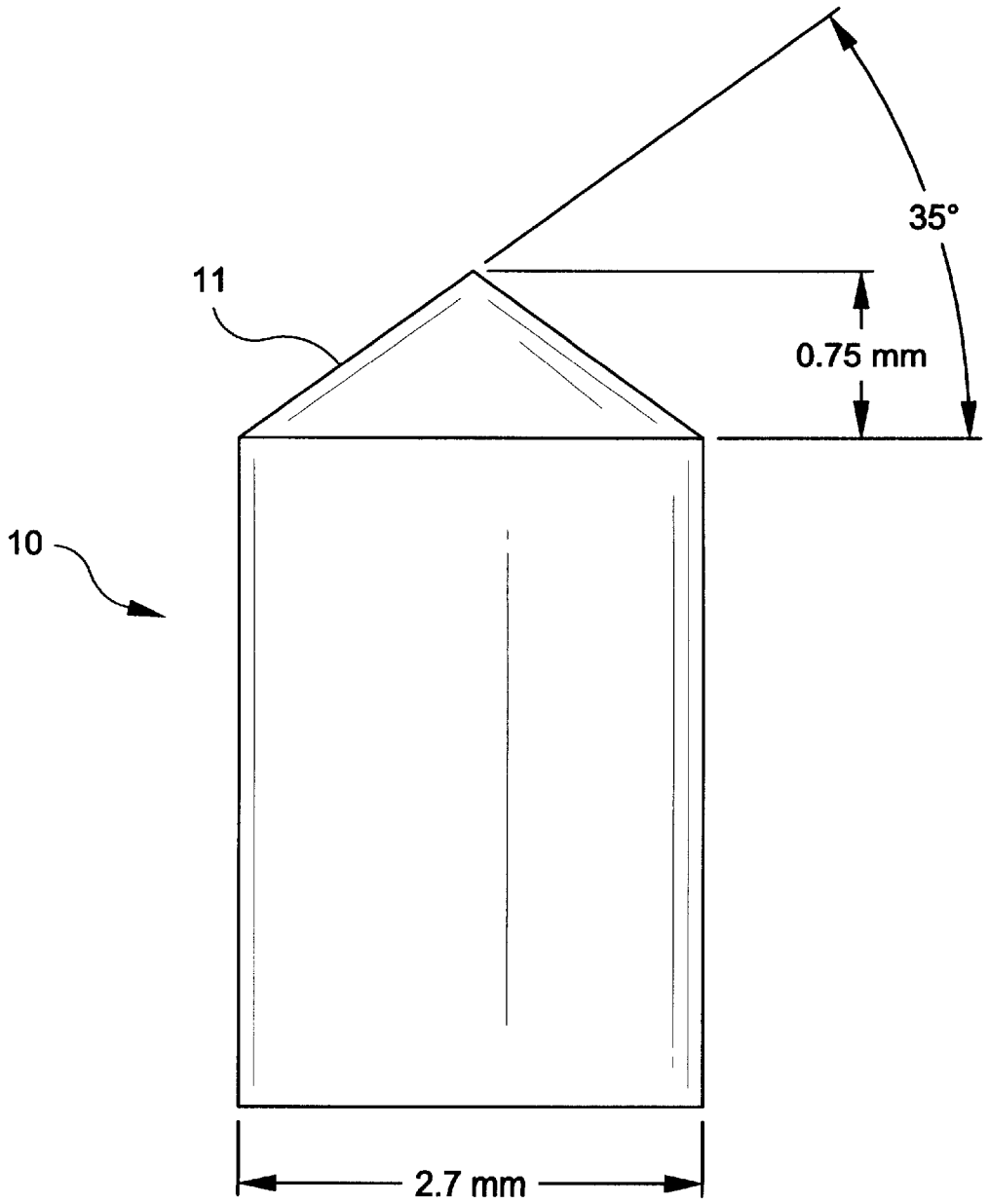
FIG. 1 is a side view of an electrochemical machining tool.

Reference will now be made to the presently preferred embodiments of the invention.

Razor blades having apertures which are commonly circular have long been manufactured by implementing traditional grinding techniques to form the cutting edges. Grinding a non-straight edge is difficult, requires extensive part manipulation, and limits the structure and design of the ultimate blade. Grind techniques often require subsequent processing such as deburring of the blades to remove dangerous burrs. The present invention provides for a method of producing a razor blade having multiple apertures with sharpened edges for shaving. The method of producing the razor blade of the present invention differs from the known methods in that it does not utilize grinding. Instead, the present invention discloses alternative methods of producing a razor blade having a plurality of cutting apertures. These alternative methods do not require extensive part manipulation or limit blade design.

It is important when forming a razor blade having a plurality of cutting apertures that the hair extends into the holes, the skin flows over the holes, and that the proper cutting angle is obtained. Cutting edges formed within an aperture do not produce the desired shaving results because hair and skin flow are minimal over the actual cutting surface of the blade. The formation of an edge extending above the shave plane greatly improves the efficiency and quality of the shave. Generally, a good example of a satisfactory system would have an aperture cutting edge protruding approximately 0.03 mm from the blade surface at approximately a 15 degree angle.

The first step in the process of forming the aperture razor blade with a cutting edge extending above the shave plane is to deform the desired shaving blade material, preferably stainless steel. The steel is deformed using a device which has multiple cones which are pressed against the steel to form dimples. The preferable dimple angle ranges from 5 to 45 degrees from the shaving plane. Virtually any desired number, shape or orientation of dimples may be produced. Following the formation of the dimples in the steel, the steel is hardened after which the holes and cutting edges are formed by one or more of the known processes of electrochemical machining (ECM), electrical discharge machining (EDM), electrolytic machining, laser-beam machining (LBM), electron-beam machining (EBM), photochemical machining (PCM), or ultrasonic machining (USM). Edge formation may be followed with supplemental metallic or non-metallic coatings and procedures standard in the art such as coating with polytetrafluoroethylene (Teflon) or other lubricious materials, followed by heat treatments. Each of the non-traditional machining procedures has various benefits and may be employed depending upon the desired result. All of the edge formation processes do not require extensive part manipulation or in any way limit blade design.

The EDM process involves the use of an EDM tool which is fed into the area to be cut. A dielectric fluid is placed into the area to be cut and rapid, repetitive spark discharges are fed between the tool and the steel to remove conductive material and consequently produce an aperture. Multiple tools may be employed to produce the multiple desired apertures. The EDM process is especially useful in situations where the cutting will be irregular and is capable of producing up to 200 simultaneous holes.

The ECM process cuts steel via anodic dissolution in a rapidly flowing electrolyte between the steel and the shaped electrode. As with EDM, ECM may be employed to simultaneously produce multiple apertures and is capable of producing up to 100 simultaneous holes. Also similarly with EDM, ECM is particularly useful for cutting in situations where the cuttings are irregular. FIG. 1 illustrates the ECM tool 10 which is fed into the area to be cut. While any desired dimensions may be chosen, preferable dimensions for the ECM tool include a width of approximately 2.7 mm., an angled cone portion 11 approximately 0.75 mm. high to form the proper cutting edge, and an angle in the range of approximately 10–40 degrees, and preferably 35 degrees, between the surface of the angled cone portion 11 and the shaving plane.

Figure 2:
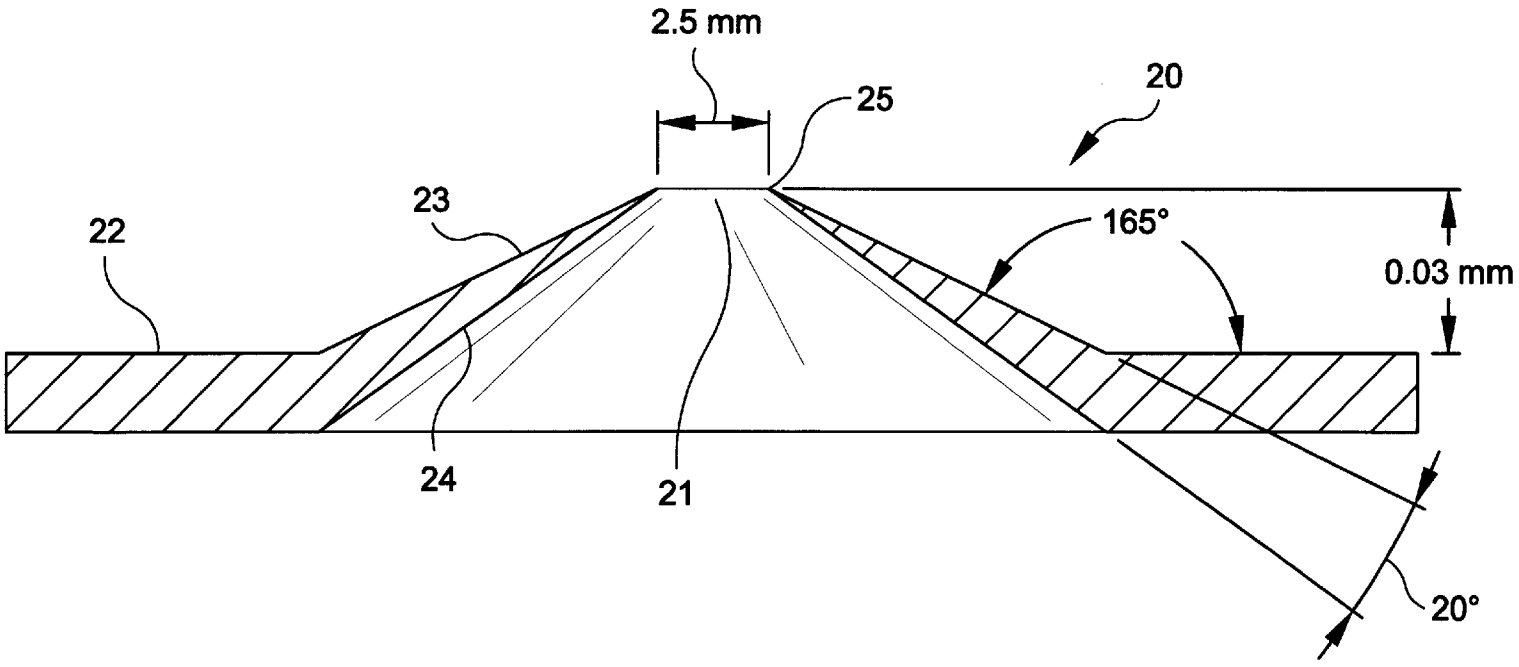
FIG. 2 is aside view of a blade aperture formed via electrochemical machining.
Figure 3:
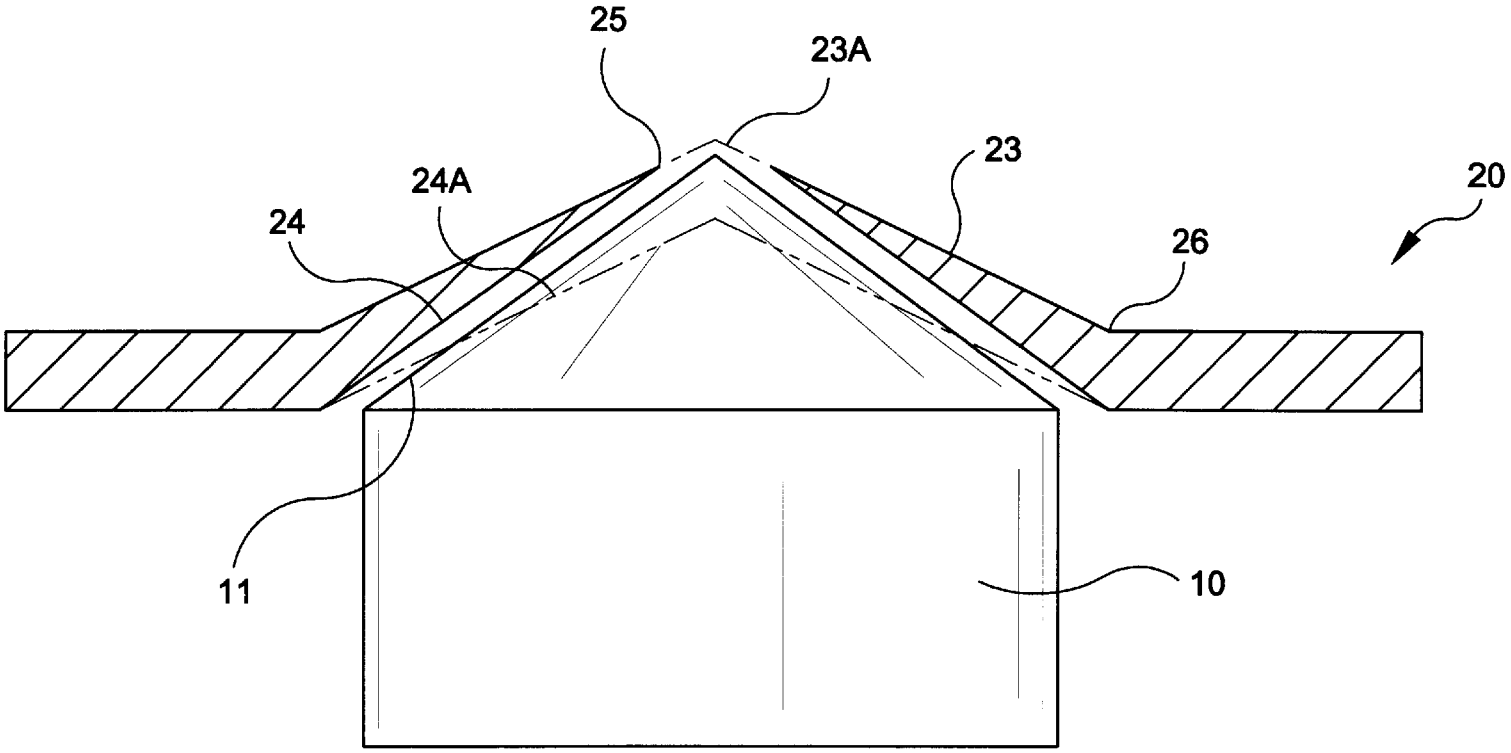
FIG. 3 is a view of a blade edge and aperture being formed via electrochemical machining.
Figure 4:
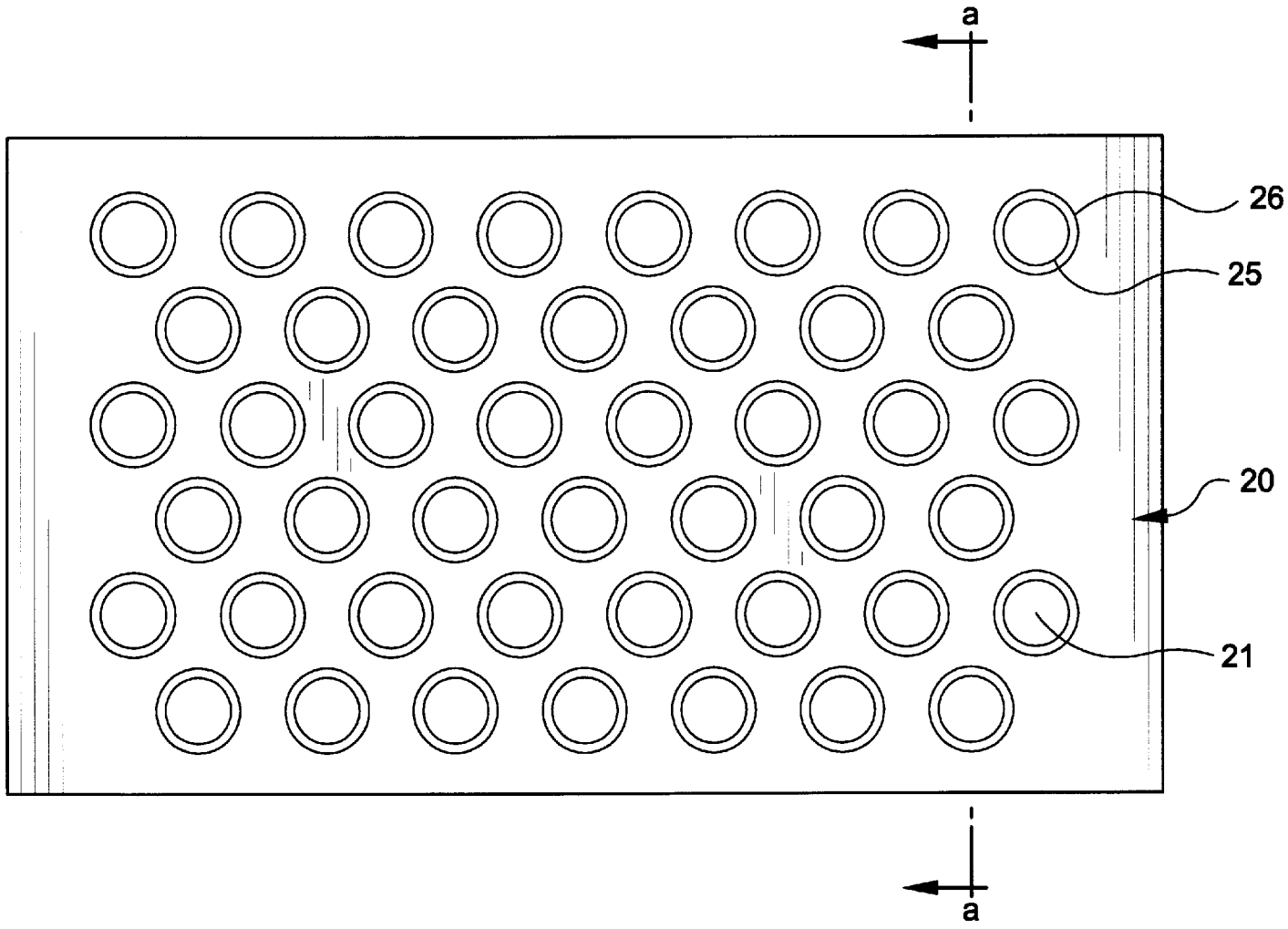
FIG. 4 is a side view of a razor blade having apertures formed via the methods of the present invention.
Figure 4A:
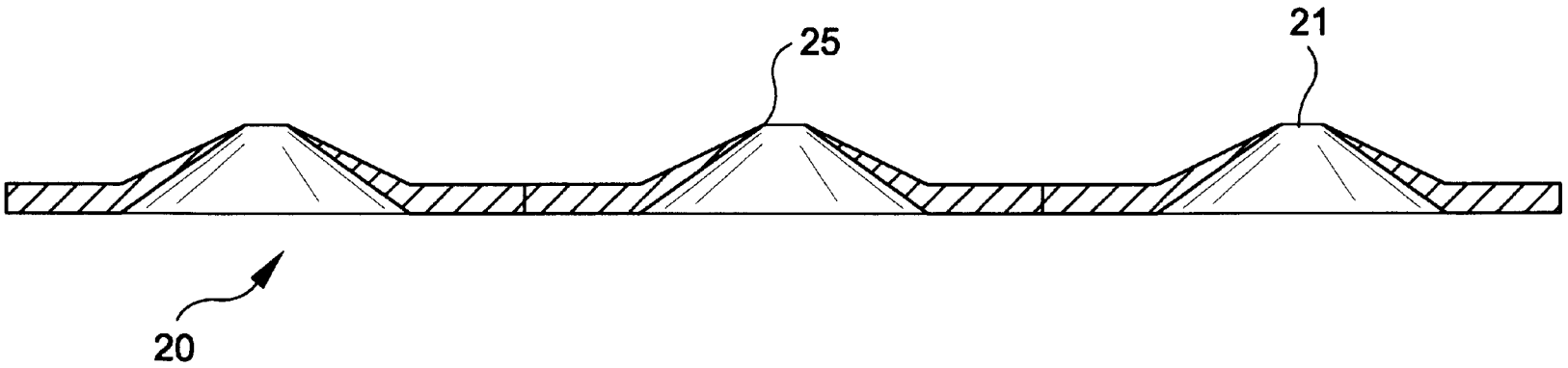
FIG. 4*a* is a view of the cross section of a razor blade having apertures formed using the methods in the present invention.

FIG. 2 illustrates the resulting apertured blade 20 manufactured using the ECM tool example above. The resulting apertured blade 20 would have the desired dimensions of an aperture width 21 of approximately 2.5 mm., a cutting edge height of approximately 0.03 mm, and a cutting angle of approximately 165 degrees between the flat edge of the blade 22 and the outside cutting edge 23 and approximately 20 degrees between the inside 24 and the outside 23 of the cutting edge. These approximate dimensions for a cutting edge on the edge of the aperture would allow skin to flow over the aperture and the hair to be easily cut. As illustrated in FIG. 3, the ECM tool 10 forms the blade edge 25 by removing material from the edge of the pre-formed dimples. The outer edge of the dimples is shown at 26. Shadow line 23A illustrates the original top of the dimple before the application of the ECM tool, while shadow line 24A illustrates the original bottom of the dimple before the application of the ECM tool. As shown in FIG. 3, the inside edge of the dimple is removed electrochemically via the ECM tool at a steeper angle forming the inside edge 24 and an aperture opening. Multiple ECM tools or an ECM tool consisting of an array of FIG. 1 structures may be employed to produce the multiple desired apertures in the desired pattern. FIGS. 4 and 4*a* illustrate examples of aperture patterns in which the apertures 21 are circular. The ECM process is especially useful in situations where the cutting will be irregular and is capable of producing up to 100 simultaneous holes.

Other alternative processes are also viable for producing razor blades having multiple cutting apertures. Electrolytic machining employs an electrolytic solution which surrounds the steel and enables DC current to flow between the tool and the steel work piece. The dissolution of the material to form the apertures is proportional to the current generated between the tool and the steel. Electrolytic machining includes the specialized full form machining technique known as ECM described earlier. Laser-beam machining is simply the cutting of the hole via melting, ablating and vaporizing the steel at the desired point. This method is especially useful in that the cutting system is rapidly adjustable, however laser machining can only practically produce two holes simultaneously. Electron-beam machining uses an electron beam to melt and vaporize the material. The electron beam consists of a focused beam of electrons accelerated to a high velocity. This technique can only practically produce one hole at a time but it produces holes at a production rate of 5000 holes per second. Photochemical machining utilizes a chemically resistant mask. The mask is formed using photographic techniques. The exposed material is either immersed in an etchant or sprayed with the etchant to remove the material exposed via a chemical reaction. This technique can form an unlimited number of holes simultaneously and is ideal for continuous strip production. Ultrasonic machining implements a tool that vibrates perpendicular to the workpiece at ultrasonic frequencies. The part is submerged in an abrasive slurry which in combination with the vibrating tool abrades the material away. This technique is practical for forming ten holes simultaneously and is known for forming sharp corners. All of these techniques generate holes through the dimple and sharpen the cutting edge via the use of a coned shaped tool with an angle greater than the angle of the dimple to form the cutting edge, as illustrated for ECM in FIG. 1 or a mask to control material removal. One or more tools may be used to either form both the hole and the sharpened edge simultaneously or sequentially. For example, the ECM can be used to form the edge while cutting the aperture or the apertures may be cut utilizing EDM, but sharpened utilizing ECM.

The structure and design of the cutting edge aperture is unlimited using non-traditional machining techniques. Circular, rounded, slotted, geometric, such as square or rectangular, and irregularly shaped features as well as any combination of these features can be formed and contoured. The contour of the cutting edge is also readily adjustable. The edge can be straight, beveled or shaped. Both lateral and longitudinal structures are readily formed using electrochemical machining, electrical discharge machining, electrolytic machining, laser-beam machining, electron beam machining, photochemical machining, ultrasonic machining, and other alternative machining techniques in a single step, in contrast to traditional grinding techniques which require extensive part manipulation and may not even be capable of producing these features.

While there have been described what are presently believed to be the preferred embodiments of the present invention, those skilled in the art will realize that various changes and modifications may be made to the invention without departing from the spirit of the invention, and it is intended to claim all such changes and modifications as fall within the scope of the invention.

I claim:

1. A method of producing a razor blade having a plurality of apertures, comprising the steps of:

forming a plurality of dimples in a razor blade material;

forming apertures in the plurality of dimples by electrochemical machining in a manner such that a cutting edge is formed on the edge of each aperture;

sharpening the cutting edges via electrochemical machining.

2. The method of claim 1, further comprising the step of forming the plurality of apertures such that each aperture is rounded, slotted, geometric, irregularly shaped or a combination thereof.

3. The method of claim 1, further comprising the step of forming the plurality of apertures such that each aperture is circular.

4. A razor blade having a plurality of apertures formed via the method of claim 1.

5. A method of producing a razor blade having a plurality of apertures, comprising the steps of:

forming a plurality of dimples in a razor blade material;

forming apertures in the plurality of dimples by electrical discharge machining in a manner such that a cutting edge is formed on the edge of each aperture;

sharpening the cutting edges via electrical discharge machining.

6. The method of claim 5, further comprising the step of forming the plurality of apertures such that each aperture is rounded, slotted, geometric, irregularly shaped or a combination thereof.

7. The method of claim 5, further comprising the step of forming the plurality of apertures such that each aperture is circular.

8. A razor blade having a plurality of apertures formed via the method of claim 5.

9. A method of producing a razor blade having a plurality of apertures, comprising the steps of:

forming a plurality of dimples in a razor blade material;

forming apertures in the plurality of dimples by electrolytic machining in a manner such that a cutting edge is formed on the edge of each aperture;

sharpening the cutting edges via electrolytic machining.

10. The method of claim 9, further comprising the step of forming the plurality of apertures such that each aperture is rounded, slotted, geometric, irregularly shaped or a combination thereof.

11. The method of claim 9, further comprising the step of forming the plurality of apertures such that each aperture is circular.

12. A razor blade having a plurality of apertures formed via the method of claim 9.

13. A method of producing a razor blade having a plurality of apertures, comprising the steps of:

forming a plurality of dimples in a razor blade material;

forming apertures in the plurality of dimples by laser-beam machining in a manner such that a cutting edge is formed on the edge of each aperture;

sharpening the cutting edges via laser-beam machining.

14. The method of claim 13, further comprising the step of forming the plurality of apertures such that each aperture is rounded, slotted, geometric, irregularly shaped or a combination thereof.

15. The method of claim 13, further comprising the step of forming the plurality of apertures such that each aperture is circular.

16. A razor blade having a plurality of apertures formed via the method of claim 13.

17. A method of producing a razor blade having a plurality of apertures, comprising the steps of:

forming a plurality of dimples in a razor blade material;

forming apertures in the plurality of dimples by electron-beam machining in a manner such that a cutting edge is formed on the edge of each aperture;

sharpening the cutting edges via electron-beam machining.

18. The method of claim 17, further comprising the step of forming the plurality of apertures such that each aperture is rounded, slotted, geometric, irregularly shaped or a combination thereof.

19. The method of claim 17, further comprising the step of forming the plurality of apertures such that each aperture is circular.

20. A razor blade having a plurality of apertures formed via the method of claim 17.

21. A method of producing a razor blade having a plurality of apertures, comprising the steps of:

forming a plurality of dimples in a razor blade material;

forming apertures in the plurality of dimples by photochemical machining in a manner such that a cutting edge is formed on the edge of each aperture;

sharpening the cutting edges via photochemical machining.

22. The method of claim 21, further comprising the step of forming the plurality of apertures such that each aperture is rounded, slotted, geometric, irregularly shaped or a combination thereof.

23. The method of claim 21, further comprising the step of forming the plurality of apertures such that each aperture is circular.

24. A razor blade having a plurality of apertures formed via the method of claim 21.

25. A method of producing a razor blade having a plurality of apertures, comprising the steps of:

forming a plurality of dimples in a razor blade material;

forming apertures in the plurality of dimples by ultrasonic machining in a manner such that a cutting edge is formed on the edge of each aperture;

sharpening the cutting edges via ultrasonic machining.

26. The method of claim 25, further comprising the step of forming the plurality of apertures such that each aperture is rounded, slotted, geometric, irregularly shaped or a combination thereof.

27. The method of claim 25, further comprising the step of forming the plurality of apertures such that each aperture is circular.

28. A razor blade having a plurality of apertures formed via the method of claim 25.

* * * * *